US006202628B1

(12) United States Patent
Iwano et al.

(10) Patent No.: US 6,202,628 B1
(45) Date of Patent: Mar. 20, 2001

(54) CONTROL APPARATUS AND CONTROL METHOD OF ENGINE

(75) Inventors: Hiroshi Iwano; Isamu Kazama; Hiraku Ooba, all of Kanagawa-ken (JP)

(73) Assignee: Nissan Motor Co. Ltd., Yokohama (JP)

( * ) Notice: Subject to any disclaimer, the term of this patent is extended or adjusted under 35 U.S.C. 154(b) by 0 days.

(21) Appl. No.: 09/409,085

(22) Filed: Sep. 30, 1999

(30) Foreign Application Priority Data

Oct. 2, 1998 (JP) ..... 10-281083

(51) Int. Cl.[7] ..... F02D 41/16
(52) U.S. Cl. ..... 123/339.16; 123/352; 123/361
(58) Field of Search ..... 123/339.16, 339.17, 123/339.18, 339.19, 352, 361, 399

(56) References Cited

U.S. PATENT DOCUMENTS 5,477,826 * 12/1995 Hara et al. ..... 123/399 X
5,492,095 * 2/1996 Hara et al. ..... 123/399 X
5,706,782 * 1/1998 Kurihara ..... 123/399

FOREIGN PATENT DOCUMENTS 4-101037 4/1992 (JP) .

* cited by examiner

*Primary Examiner*—Tony M. Argenbright
(74) *Attorney, Agent, or Firm*—Foley & Lardner

(57) ABSTRACT

The disclosed control apparatus and method of an engine of the present invention calculates a target engine torque using an operation amount of an accelerator, converting the target engine torque into a first opening area of a throttle valve, calculates a required air amount at the time of idling, converting the required air amount into a second opening area of the throttle valve, calculates a target total opening area of the throttle valve by adding the first opening area and the second opening area of the throttle valve, calculates a target opening degree of the throttle valve in correspondence to the target total opening area, and outputs the target opening degree to the throttle valve controller which controls an opening degree of the throttle valve.

11 Claims, 7 Drawing Sheets

CONTROL APPARATUS AND CONTROL METHOD OF ENGINE

BACKGROUND OF THE INVENTION

The present invention relates to a control apparatus and a control method of an engine, and more particularly, to a control an engine provided, in its intake passage, with a throttle valve which is driven by a throttle valve control device such as a DC motor.

Japanese Patent Application Laid-open No. Hei4-101037 discloses a control apparatus of an engine which realizes engine torque required by a driver (which will be referred to as "required torque" hereinafter). This apparatus calculated the required torque of the driver based on a depressing amount of an accelerator pedal which is the accelerator operating amount. Based on the calculated required torque, a throttle valve opening degree and a fuel injection amount are set, and the required torque is realized using the intake air amount, in accordance with the set throttle valve opening degree, and the set fuel injection amount.

SUMMARY OF THE INVENTION

According to the study of the present inventors, in the case of the conventional control apparatus of the engine, when the driver depresses the accelerator pedal and requires the torque from the idling state in which the throttle valve opening degree is controlled such that the idling does not become unstable due to the operation of the load of an auxiliary equipment, torque shock may be generated, and the engine speed may unintentionally be lowered. Such a phenomenon may cause a sense of incongruity for the driver, and it is not preferable for a quality as goods.

Main factor thereof is that an amount of air required for stabilizing the idling (which will be referred to as "idling required air amount" hereinafter) is not added to the required torque of the driver, i.e., is not synthesized.

This will be explained in more detail with reference to FIGS. 10A and 10B which show the relation between the opening area Aa of the throttle valve and the engine torque Te.

First, when the load of the auxiliary equipment is not operated at all at the time of idling, the opening area Aa of the throttle valve is controlled such that the opening area Aa takes the point A in FIG. 10A so as to compensate the friction and pumping loss of the engine to keep the idling stably.

On the other hand, the auxiliary equipment load is operated at the time of idling, the opening area Aa of the throttle valve is controlled such that it takes the point A in FIG. 10B so as to compensate the contribution by the operation of the auxiliary equipment load to keep the idling stably, in addition to compensation of the friction and the pumping loss of the engine. The point A in FIG. 10B has a value greater than the point A in FIG. 10A by the engine torque Teal which corresponds to the auxiliary equipment load.

Next, in a state in which the auxiliary equipment load is operated at the time of idling, assume that the accelerator pedal is depressed a little to turn an idle switch OFF, and the opening area Aa of the throttle valve is controlled to be the point D in FIG. 10A. The point D in FIG. 10A has a value greater than the point A in FIG. 10A by Te5 which corresponds to the small depression of the accelerator pedal. This engine torque Te5 has a value which is smaller than the engine torque Teal of the point A of FIG. 10B. Therefore, this means that even though the accelerator pedal is depressed, the engine torque itself is reduced from Teal to Te5.

Since the idle switch is turned OFF and the engine torque is reduced from Teal to Te5 in this manner, the torque shock may be caused or the engine speed may be lowered unintentionally. Further, as the difference between these values is greater, a greater torque shock may be caused or the engine speed may be caused more remarkably.

The present invention has been accomplished in view of these studies, and it is an object of the invention to prevent the torque shock from being generated and to prevent the engine speed from being lowered unintentionally when a driver depresses the acceleration pedal and requires the engine torque in the operation state of the load of the auxiliary equipment at the time of idling, typically.

To achieve the above object, according to the present invention, a required torque of a driver and an idling required air amount are respectively converted into opening area of a throttle valve and then added, and the added value is defined as a target opening area of the throttle valve so that the intake air amount of the engine continues smoothly.

That is, a control apparatus of an engine of the present invention comprises: a throttle valve controller capable of controlling an opening degree of a throttle valve independent from an accelerator; a target torque calculating section calculating a target engine torque using an operation amount of the accelerator; a first opening area calculating section converting the target engine torque into a first opening area of the throttle valve; an idling required air amount calculating section calculating a required air amount at the time of idling; a second opening area calculating section converting the required air amount into a second opening area of the throttle valve; a total opening area calculating section adding the first opening area of the throttle valve and the second opening area of the throttle valve to calculate a target total opening area of the throttle valve; a target opening degree calculating section calculating a target opening degree of the throttle valve in correspondence to the target total opening area; and an output section outputting the target opening degree to the throttle valve controller.

In other words, a control apparatus of an engine of the invention comprises: throttle valve control means for controlling an opening degree of a throttle valve; target torque calculating means for calculating a target engine torque using an operation amount of the accelerator; first opening area calculating means for converting the target engine torque into a first opening area of the throttle valve; idling required air amount calculating means for calculating a required air amount at the time of idling; second opening area calculating means for converting the required air amount into a second opening area of the throttle valve; total opening area calculating means for adding the first opening area of the throttle valve and the second opening area of the throttle valve to calculate a target total opening area of the throttle valve; target opening degree calculating means for calculating a target opening degree of the throttle valve in correspondence to the target total opening area; and output means for outputting the target opening degree to the throttle valve control means.

On the other hand, a control method of an engine of the invention comprises the steps of: calculating a target engine torque using an operation amount of an accelerator; converting the target engine torque into a first opening area of a throttle valve; calculating a required air amount at the time of idling; converting the required air amount into a second opening area of the throttle valve; calculating a target total opening area of the throttle valve by adding the first opening area of the throttle valve and the second opening area of the throttle valve; calculating a target opening degree of the throttle valve in correspondence to the target total opening area; and controlling the throttle valve based on the target opening degree of the throttle valve.

DETAILED DESCRIPTION OF THE PREFERRED EMBODIMENT

An embodiment of the present invention will be explained in detail with reference to the drawings below.

Figure 1:
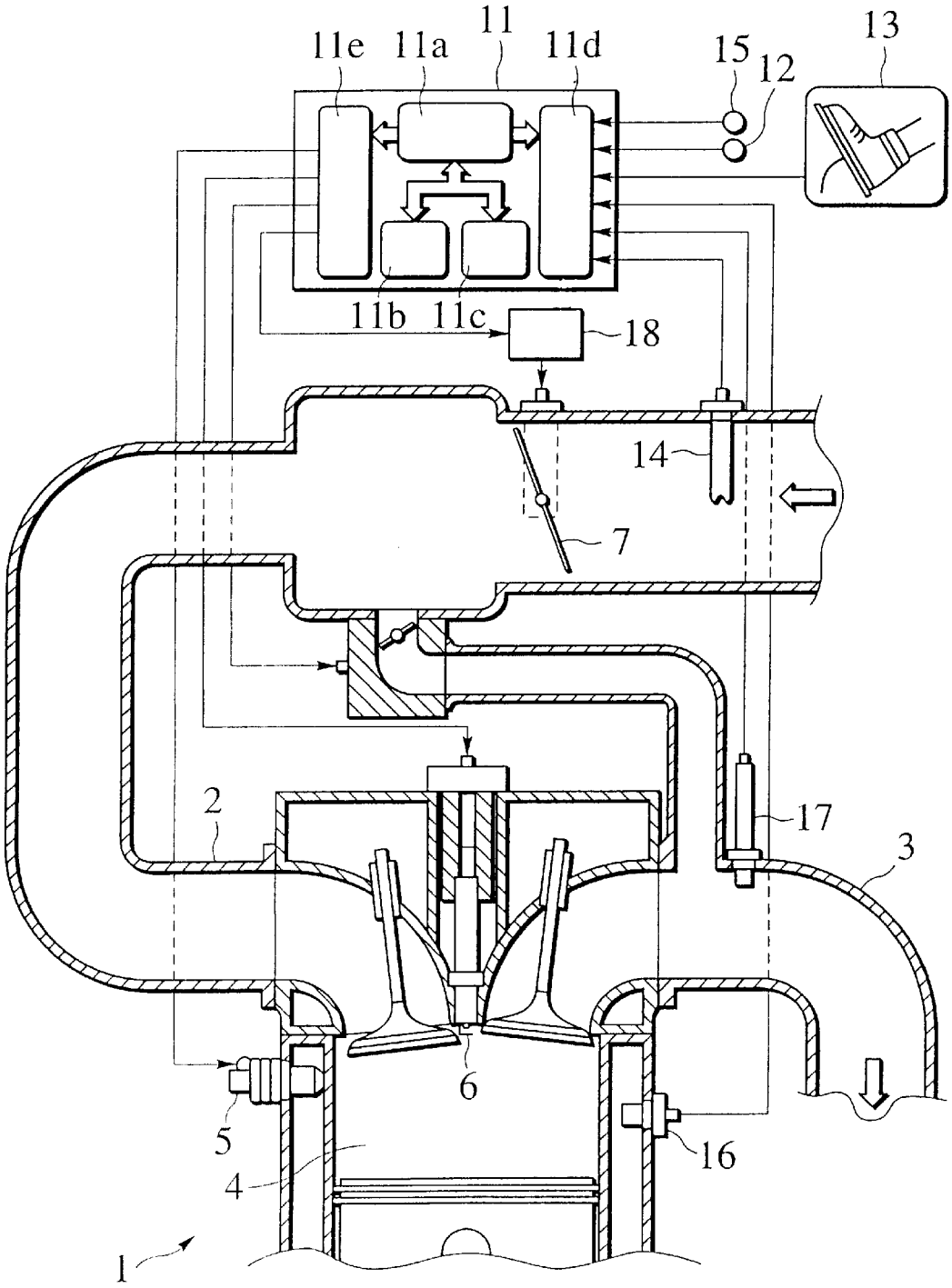
FIG. 1 is a view showing a structure of a control apparatus of an engine according to an embodiment of the present invention.

In FIG. 1, an engine 1 is provided with an intake passage 2 and an exhaust passage 3 which are in communication with a combustion chamber 4. The combustion chamber 4 is directly provided with an injector 5, and is provided at its top portion with a spark plug 6. The intake passage 2 is provided with a butterfly type throttle valve 7 for controlling a flow rate of intake air entering along the arrow from an air cleaner which is not shown. An exhaust gas flowing out from the exhaust passage 3 along the arrow reaches a catalyst which is not shown.

The engine 1 is controlled by a control unit 11. The engine control unit 11 comprises a CPU 11*a*, a ROM 11*b*, a RAM 11*c*, an input port 11*d* and an output port 11*e*. Input to the input port 11*d* of the control unit 11 are: an ignition signal corresponding to ON/OFF from an ignition switch 12; an accelerator operating signal corresponding to an operation amount of an acceleration pedal, i.e., corresponding to an accelerator stroke from an accelerator sensor 13; an intake air flow rate signal corresponding to an intake air flow rate from an air flow meter 14 provided in the intake passage 2; an engine speed signal corresponding to the engine speed from a crank angle sensor 15 provided in the engine 1; a signal corresponding to a unit crank angle from the crank angle sensor 15; a signal corresponding to a reference crank angle from the crank angle sensor 15; a cooling water temperature signal corresponding to the water temperature from a water temperature sensor 16 provided in a cooling passage of the engine 1; an oxygen concentration signal in the exhaust gas from an oxygen sensor 17 provided in the exhaust passage 3, and the like. These signals are input to the CPU 11*a* through the input port 11*d*, and are stored in memory such as the RAM 11*c* as necessary. As the operation amount of the accelerator pedal, a time variation amount of the accelerator stroke may be used instead of the accelerator stroke.

Here, the CPU 11*a* calculates a target engine torque using these signals, and calculates a target air amount and a target fuel amount such that the target engine torque can be obtained.

The control unit 11 outputs a signal corresponding to the target air amount from the output port 11*e* to a throttle valve controller 18, and controls the throttle valve 7 through the throttle valve controller 18 so that the target air amount is realized. More specifically, the opening degree of the throttle valve is detected by a throttle sensor which is not shown. The throttle valve controller 18 feedback controls the throttle valve 7 such that the opening degree of the throttle valve 7 coincides with the target opening degree corresponding to the target air amount. On the other hand, the control unit 11 outputs a signal corresponding to the target fuel injection amount from the output port 11*e* to the injector 5 so that the target injection amount is realized, and controls the injector 5.

Besides, the control unit 11 also controls the ignition timing of the spark plug 6, an EGR and the like.

In the present embodiment, when the control unit 11 controls the throttle valve 7 so as to stabilize the idling under the condition in which the load of the auxiliary equipment is operated at the time of idling, if the driver depresses the accelerator pedal and requires the engine torque, the control unit 11 synthesizes the idling required air amount to the required torque of the driver under the condition in which the load of the auxiliary equipment is operated at the time of idling. This is for making the intake air amount smooth, and for preventing the torque shock and the unintentional reduction of the engine speed.

The operation of the control unit 11 for such control will be explained in detail with reference to FIGS. 2 to 10B. This operation is executed at a predetermined time interval, e.g., every 10 (ms) after the ignition switch is turned On and until the ignition switch is turned OFF.

Figure 2:
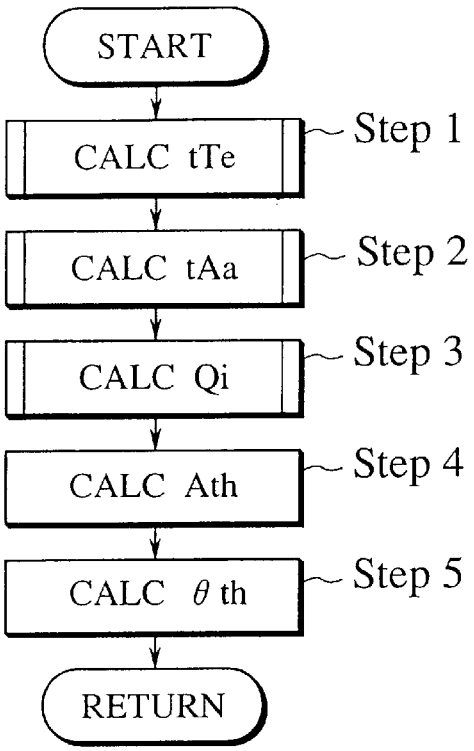
FIG. 2 is a flowchart for obtaining a target opening degree of a throttle valve of the embodiment.
Figure 3:
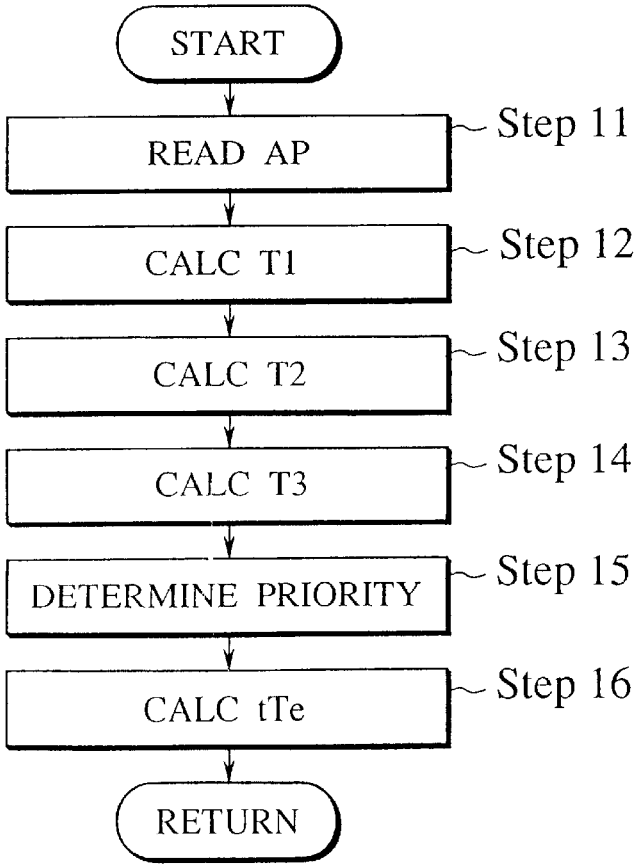
FIG. 3 is a flowchart for obtaining a target engine torque of the embodiment.
Figure 5:
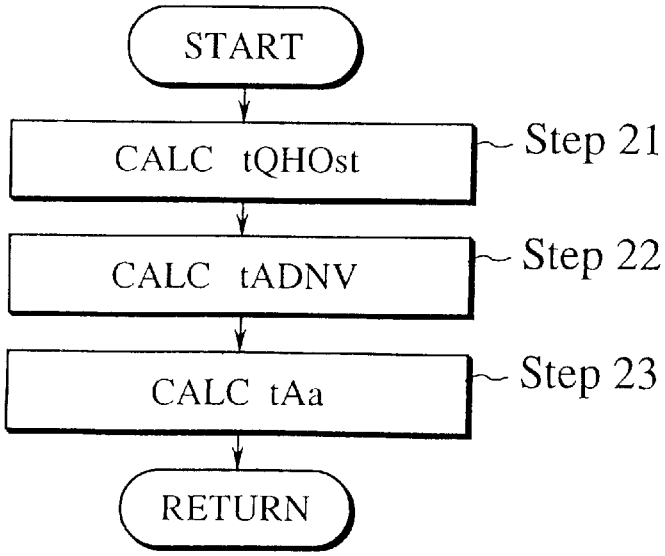
FIG. 5 is a flowchart for obtaining an opening area of a throttle valve of the embodiment.
Figure 8:
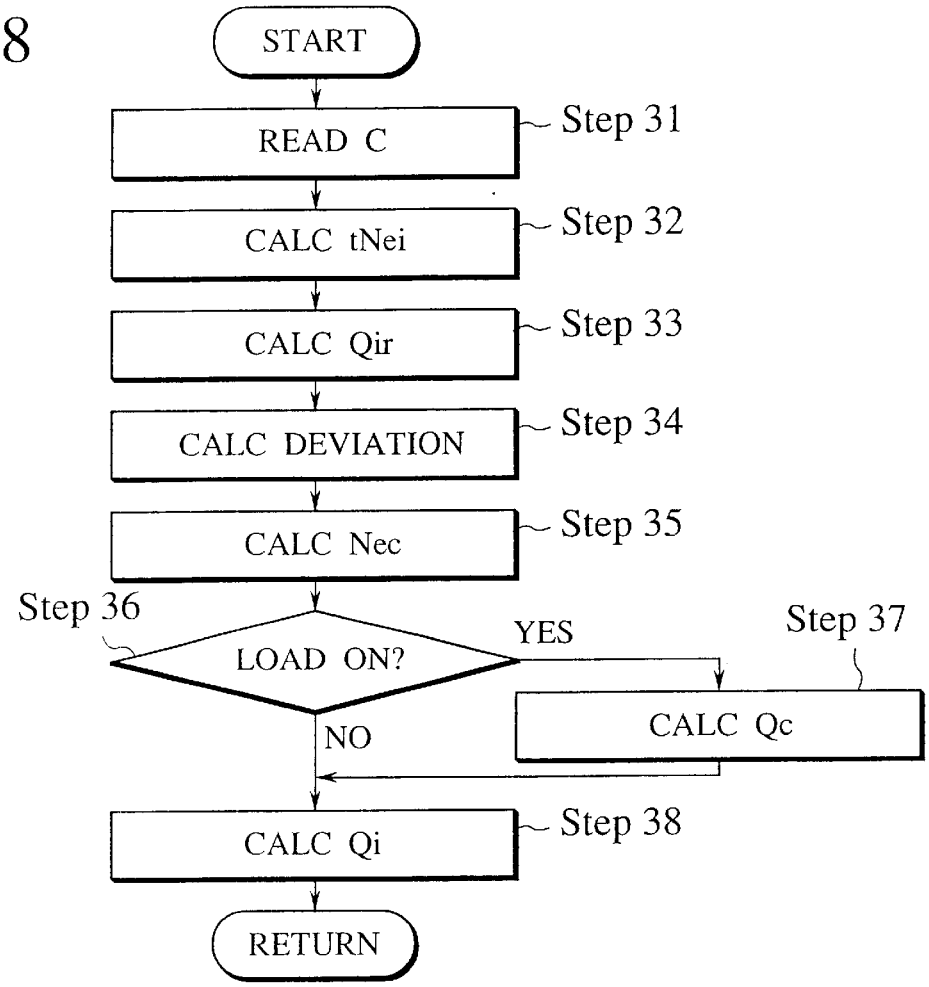
FIG. 8 is a flowchart for obtaining an idling required air amount of the embodiment.
Figure 9:
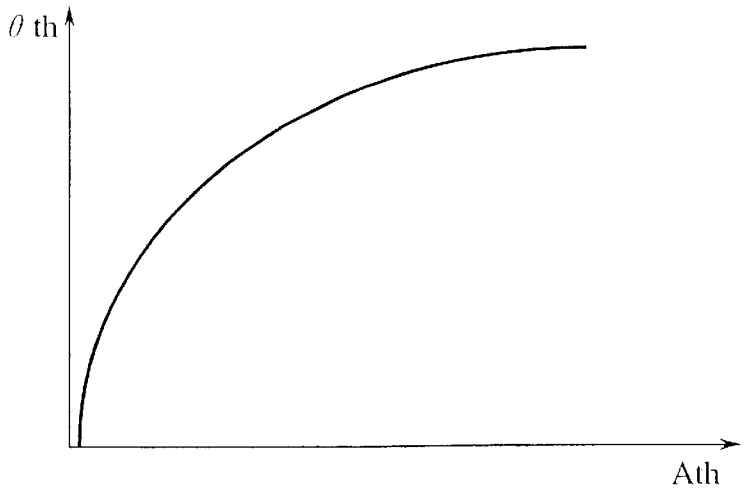
FIG. 9 is a view showing characteristics of an opening degree of the throttle valve with respect to the opening area of the throttle valve.

FIG. 2 is a flowchart for calculating a throttle valve target opening degree θth. Here, FIG. 2 shows a main routine, and FIGS. 3, 5 and 8 show sub-routines of the main routine in FIG. 2. Therefore, in the following description, if a step having the sub-routine appears when the main routine is explained, this means the sub-routine is explained.

In step 1 of FIG. 2, a vehicle stabilizing required torque (required torque in view of stability of the vehicle) T2 and a constant speed running required torque (required torque in view of constant speed running) T3 are calculated in addition to the required torque T1 of the driver, and synthesized value thereof are calculated as a target engine torque tTe. Calculation of this target engine torque tTe will be explained using the sub-routine in FIG. 3.

In steps 11 and 12 in FIG. 3, an accelerator operating amount AP is read, and the required torque T1 of the driver is calculated based on the accelerator operating amount AP.

Figure 4:
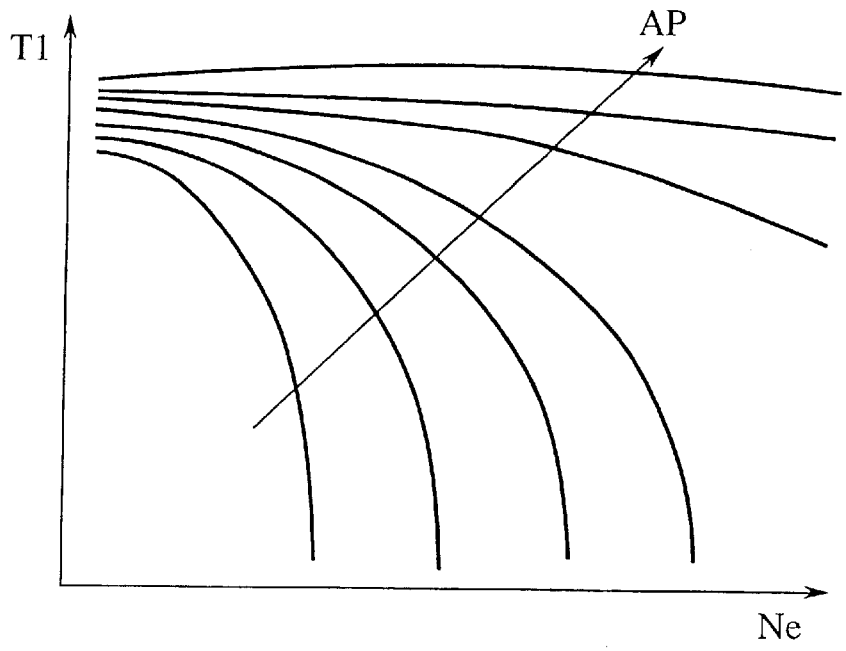
FIG. 4 is a view showing characteristics of a required torque of a driver with respect to an engine speed of the embodiment.

This value was obtained by retrieving a map shown in FIG. 4 from the accelerator operating amount AP and the engine speed Ne. There is another method in which the required driving force of the vehicle is obtained from the accelerator operating mount and the vehicle speed, and this required driving force is converted into the required torque of the driver while taking the gear ratio of the driving force transmitting system into consideration.

In step 13, the vehicle stabilizing required torque T2 is calculated. There is, for example, traction control which restrains the engine torque when slip is detected in the driving wheel to stabilize the vehicle. The required torque in this traction control corresponds to T2.

Similarly, the constant speed running required torque T3 is calculated in step 14. There is, for example, automatic speed control which allows the vehicle to run at constant speed during running at a high speed. The required torque in this automatic speed control corresponds to T3. For example, when the vehicle shall be running at 80 km/h, the sum of a basic torque required for running at 80 km/h and a feedback torque required for maintaining this speed is T3.

In steps 15 and 16, priorities of these three required torque T1, T2 and T3 are determined, and the target engine torque tTe which corresponds to that the engine must generate eventually is synthesized. Here, the way to synthesize the target engine torque will be explained concretely using the following examples (1) to (4), while it is assumed that the traction control always waits in its operable state.

(1) When the automatic speed control is operated: At this time, since the driver should have released the accelerator pedal, the target engine torque is T3.

(2) When the traction control is operated at the time of operation of the automatic speed control: Since the traction control should have gain a priority, the operation of the automatic speed control is stopped for the time being. Therefore, the target engine torque is T2.

(3) When the driver depressed the accelerator pedal: Since the driver's will should gain a priority, the traction control is released. Therefore, the target engine torque is T1.

(4) When the traction control is operated while the driver is depressing the accelerator pedal: The target engine torque corresponds to the sum of T1 and T2. In this case, T2 is a negative value.

If the target engine torque tTe is calculated in this manner, the procedure is returned to FIG. 2, and this target engine torque tTe is converted into the target opening area tAa of the throttle valve in step 2. The conversion into the opening area will be explained using the sub-routine in FIG. 5.

Figure 6:
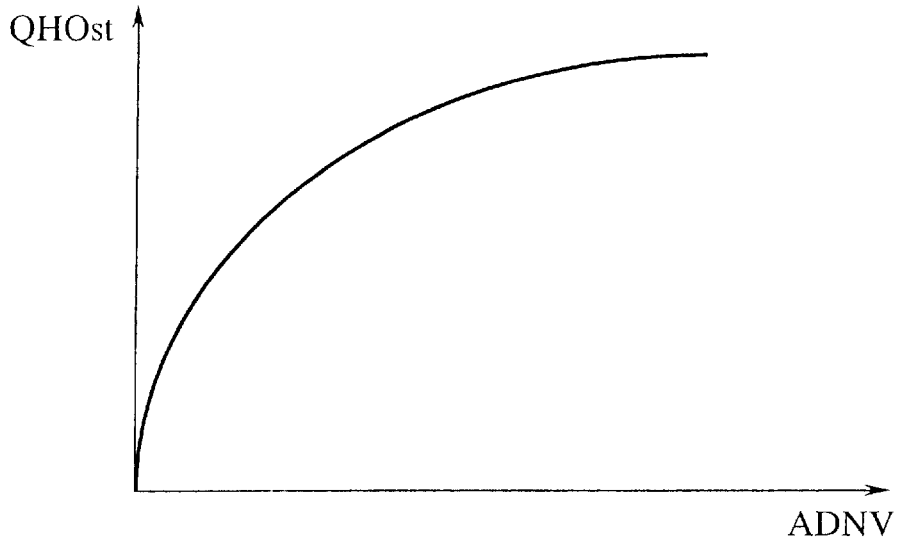
FIG. 6 is a view showing characteristics of a reference intake amount ratio with respect to a normalized opening area of the embodiment.
Figure 7:
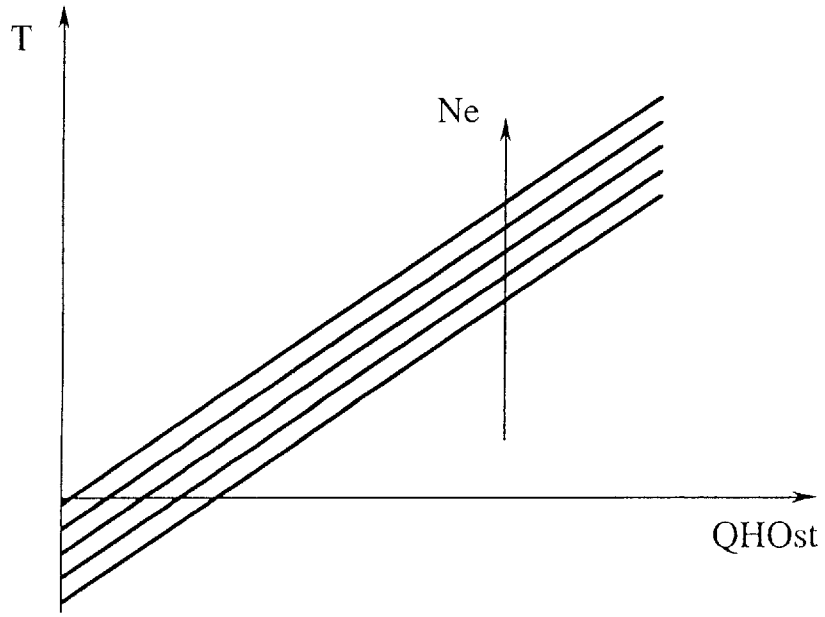
FIG. 7 is a view showing characteristics of an engine torque with respect to a reference intake amount of the embodiment.

Here, before FIG. 5 is explained concretely, the characteristics of FIGS. 6 and 7 are be explained. A value obtained by dividing the opening area Aa of the throttle valve by the engine speed Ne and the piston displacement Ve is defined as a normalized opening area ADNV (=Aa/(Ne×Ve)), and this normalized opening area ADNV is shown in an axis of abscissas in FIG. 6. A ratio of an intake amount Qac per one cycle (region of 720° of crank angle in the case of a four-cylinder engine) to its maximum value Qac-max regarding each engine speed is determined as a reference intake amount ratio QH0st (=Qac/Qac-max), and this reference intake amount ratio QH0st is shown in an axis of ordinates in FIG. 6. As shown in FIG. 6, irrespective of the engine speed and the piston displacement, there is a certain correlation between the normalized opening area ADNV and the reference intake amount ratio QH0st. Further, if on the condition where air fuel ratio (A/F) is constant, the correlation between the reference intake amount ratio QH0st and the engine torque T is summarized regarding each engine speed Ne, the correlation is indicated substantially linearly as shown in FIG. 7.

Turning to FIG. 5, in step 21 in FIG. 5, the reference intake amount ratio QH0st (i.e., target reference intake amount ratio tQH0st) of the target engine torque tTe is calculated from the characteristics of the engine torque T—the reference intake amount ratio QH0st. This can be obtained by previously mapping the characteristics of the engine torque T—the reference intake amount ratio QH0st shown in FIG. 7 based on the actual machine data, and by retrieving the map from the current target engine torque tTe and the current engine speed Ne.

In step 22, the target normalized opening area tADNV is calculated from the obtained target reference intake amount ratio tQH0st. This can be obtained by using the table using the correlation shown in FIG. 6 as it is, and by retrieving the table from the target reference intake amount ratio tQH0st. Then, in step 23, the target opening area tAa of the throttle valve is calculated from the target normalized opening area tADNV in accordance with the following equation:

$$tAa = tADNV \times Ne \times Ve$$

This tAa is a value obtained by converting the target engine torque tTe into the opening area of the throttle valve.

By converting the target engine torque tTe into the opening area of the throttle valve using the characteristics shown in FIGS. 6 and 7 in this manner, such matching becomes easier as compared with the case in which this conversion is carried out by a typical map retrieval. The typical map in this case is a map of the throttle valve opening area using the engine torque and the engine speed as parameters. Since data of throttle valve opening area is required on each engine speed basis, the amount of map data is remarkably increased, but the characteristics of FIG. 6 do not relay depend on the engine speed, and although the characteristics of FIG. 7 use the engine speed as the parameter, data at two point will suffice for one kind of the engine speed because the characteristics are linear one.

When the conversion into the throttle valve opening area is completed, the procedure is returned to FIG. 2, and in step 3, the idling required air amount Qi is calculated. The calculation of the idling required air amount Qi will be explained using sub-routine in FIG. 8.

In steps 31 and 32 in FIG. 8, a driving condition C of the engine 1 such as cooling water temperature and the like is read, a target engine speed tNei at the time of idling is calculated in accordance with the read driving condition C, and an air amount required for maintaining this target engine speed (engine speed maintaining air amount Qir) is calculated in step 33. This engine speed maintaining air amount Qir may be obtained by retrieving a predetermined map from the target engine speed tNei and the cooling water temperature for example.

In addition, the target engine speed tNei becomes higher as the cooling water temperature becomes lower when a neutral switch is ON for example. Whereas, when the neutral switch is OFF, the target engine speed tNei is substantially constant even if the cooling water temperature is low.

In steps 34 and 35, a deviation between the actual idling engine speed and the target engine speed tNei is calculated, and a feedback correction value Nec of the engine speed by a PID control is calculated in accordance with this deviation. Another general feedback control may be used of course.

Next, in step 36, a state of loads of auxiliary equipment such as electric loads of an air conditioner, a power steering and the like is read. If the auxiliary equipment load is operated, the procedure is advanced to step 37 where an auxiliary equipment load correction air amount Qc (air amount required for correcting the auxiliary equipment load) is calculated based on the state of the auxiliary equipment load.

In step 38, this auxiliary equipment correction air amount Qc is further added to the air amount which corresponds to the sum of the engine speed maintaining air amount Qir and the speed feedback correction amount Nec, and by this addition, the idling required air amount Qi is calculated.

On the other hand, if the auxiliary equipment load is not operated, the procedure is advanced from step 36 to step 38 bypassing step 37, and an air amount which corresponds to the sum of the engine speed maintaining air amount Qir and the speed feedback correction amount Nec is calculated as the idling required air amount Qi.

If the idling required air amount Qi has been calculated in this manner, the procedure is again returned to FIG. 2. In step 4, supposing that the flow speed of the intake air is in a sonic region, this idling required air amount Qi is converted into the throttle valve opening area Aa(ISC), and a value obtained by adding this converted value of the throttle valve opening area Aa(ISC) from the idling required air amount Qi and the target opening area tAa is calculated as a target total opening area Ath (=tAa+Aa (ISC)). Here, the sonic region means a region where the flow speed of the intake air is constant, i.e., sonic speed. Of course, the correlation between the idling required air amount Qi and the opening area Aa(ISC) may be previously prepared on a table, and the conversion may be carried out using this table.

In subsequent step 5, the throttle valve target opening degree θth is calculated in accordance with this target total opening area Ath. The throttle valve target opening degree θth is obtained by making, as a table, the correlation between the opening area Ath and the opening degree θth shown in FIG. 9 which are determined by the shape and the size of the throttle body and the throttle valve, and by retrieving this table. With the above steps, the series of this process is completed.

The throttle valve target opening degree θth obtained in this manner is output to the throttle valve control apparatus 8, and the throttle valve control apparatus 8 drives the throttle valve 7 such that the actual opening degree of the throttle valve 7 coincides with the target opening degree θth.

Figure 10A:
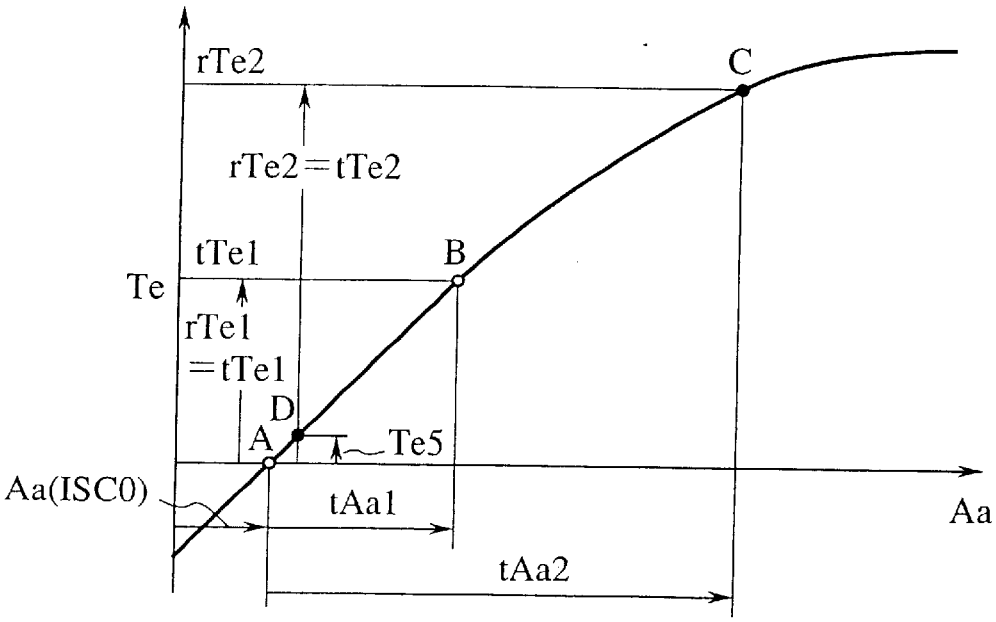
FIG. 10A is a view showing the relation of an opening area of an throttle valve with respect to an engine torque when there is no load of an auxiliary equipment.
Figure 10B:
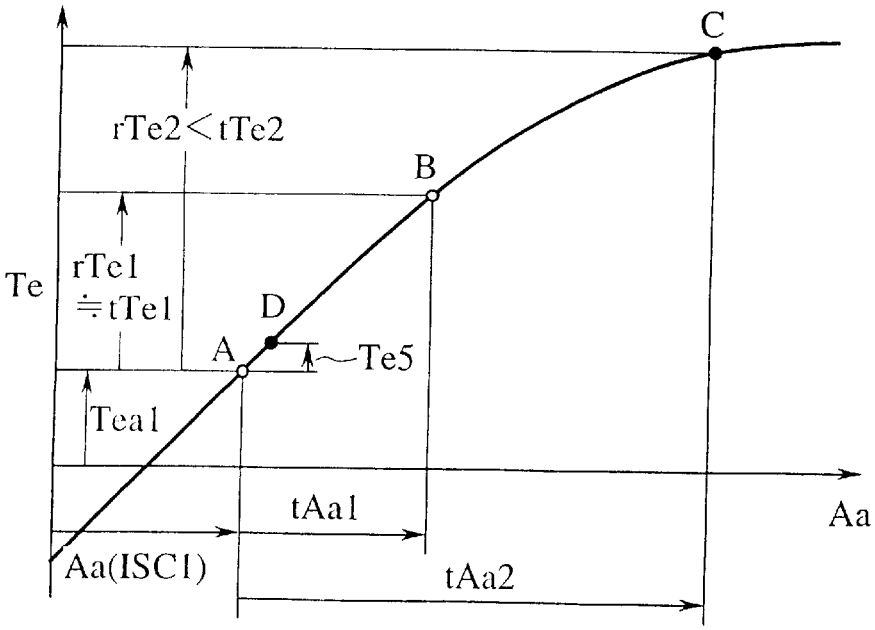
FIG. 10B is a view showing the relation of an opening area of a throttle valve and an engine torque when there is a load of an auxiliary equipment.

The torque operation according to the present embodiment will be explained with reference to FIGS. 10A and 10B. FIGS. 10A and 10B show, as models, the variation of the output torque (i.e. engine torque Te) with respect to the throttle valve opening area Aa in a state in which the predetermined engine speed is maintained.

First, FIG. 10A shows a case in which the load of the auxiliary equipment is not operated at all at the time of idling. The idling required air amount for compensating the friction or pumping loss of the engine to maintain the idling state is calculated. The opening area (Aa(ISC0)) is obtained such that the opening area becomes a point (A) at which the output torque becomes zero.

In this state, if the accelerator pedal is depressed and the target engine torque (tTel) in accordance with the accelerator operation amount is required, a point (B) in accordance with the target engine torque tTel is determined based on the characteristics of the opening area Aa-torque Te, and the target opening area (tAa1) corresponding to this torque is obtained. As a result, the target total opening area of the throttle valve becomes Aa(ISC0)+tAa1 and with this, the actual engine torque (rTe1) coincides with the target value (tTe1).

Even if a greater target engine torque (tTe2) is required, a point (C) is determined similarly, and a target opening area tAa2 corresponding to this torque is obtained. As a result, the target total opening area becomes Aa(ISC0)+tAa2 and in this case also, the actual engine torque (rTe2) coincides with the target value (tTe2).

Whereas, FIG. 10B shows a case in which the load of the auxiliary equipment is operated at the time of idling. At that time, the idling required air amount for compensating the load of the auxiliary in addition to the friction and the pumping loss of the engine so as to maintain the idling is calculated. The opening area (Aa(ISC1)) is obtained such that the opening area becomes the point (A) at which the torque is greater by the auxiliary equipment load torque (Teal). In this case, the point A is a point at which the output torque of the engine is zero, and this point A is a reference point in the state in which the auxiliary equipment load is operated.

If the accelerator pedal is operated and the target engine torque tTe1 is required from this state, the target opening area tAa1 corresponding to this target torque is obtained based on the characteristic of opening area Aa-torque Te shown in FIG. 10B similarly in FIG. 10A, and this value is added to the opening area (Aa(ISC1)) of the point A. Therefore, the target total opening area becomes Aa(ISC1)+tTe1, and the point B is determined. As a result, if the point B is within the sonic region, the actual engine torque (rTe1) becomes a value substantially equal to the target value (rTe1).

A further greater target engine torque (tTe2) is required, the target opening area tAa2 corresponding to this torque is determined similarly, and this value is added to the opening area Aa(ISC1) of the point A, and the target total opening area becomes Aa(ISC1)+tAa2 so that the point C is determined. If the point C exceeds the sonic region, the actual engine torque (rTe2) becomes a value smaller than the target value (tTe2).

As described above, in the present embodiment, the throttle valve opening area Aa(ISC) in accordance with the idling required air amount is obtained, and by determining the point corresponding to this throttle valve opening area Aa(ISC) as the origin, the opening area tAa in accordance with the required torque of the driver is added to that point. Therefore, it is possible to meet both the driver's requirement of the engine torque and the intake amount requirement for stabilizing the idling state.

Although there has been described a case in which the accelerator pedal is depressed a little from a state in which the auxiliary equipment load is operated at the time of idling in the conventional apparatus, it will be described what will happen if the same thing is done under the same condition in the present embodiment. According to the present embodiment, a driving point moves from the point A in FIG. 10B to the point D in FIG. 10B, and a torque difference between these points becomes Te5. That is, in the present embodiment, the characteristics of FIG. 10B is used before and after the accelerator pedal is depressed. Therefore, even if the accelerator pedal is depressed in the present embodiment, the torque is only increased from Tea1 to Tea1+Te5. As a result, the intake air amount is not varied abruptly when the driver depresses the accelerator pedal from the state in which the auxiliary equipment load is operated (state of idling required torque) and requires torque. Therefore, it is possible to effectively prevent the torque shock and the engine speed from being lowered unintentionally.

In addition, since the gain of the engine torque Te with respect to the throttle valve opening area Aa becomes smaller as the accelerator operation amount (load) becomes greater, although the actual precision (absolute value) of the required torque becomes lower at the side of the high load in the operating state of the auxiliary equipment load, the ratio with respect to the maximum torque at the time when the throttle valve is fully opened and the continuity of the torque reaching the maximum torque is the same as that obtained by the existing mechanical throttle operation.

In the present embodiment, the described case is that the another required torque which is different from the required torque in accordance with the accelerator operation amount is the required torque from the stabilization or the constant running of the vehicle. However, the present invention should not be limited to this only, and the invention may also be applied to a case in which the another required torque is a torque in a vehicle dynamics control (VDC) for preventing from slipping sideways or an intelligent transport system (ITS). Of course, such another required torque is not an indispensable torque, and consideration may be omitted if necessary.

The various maps and tables used in the present embodiment are previously stored in the ROM 11*b* in the control unit 11.

Figure 11:
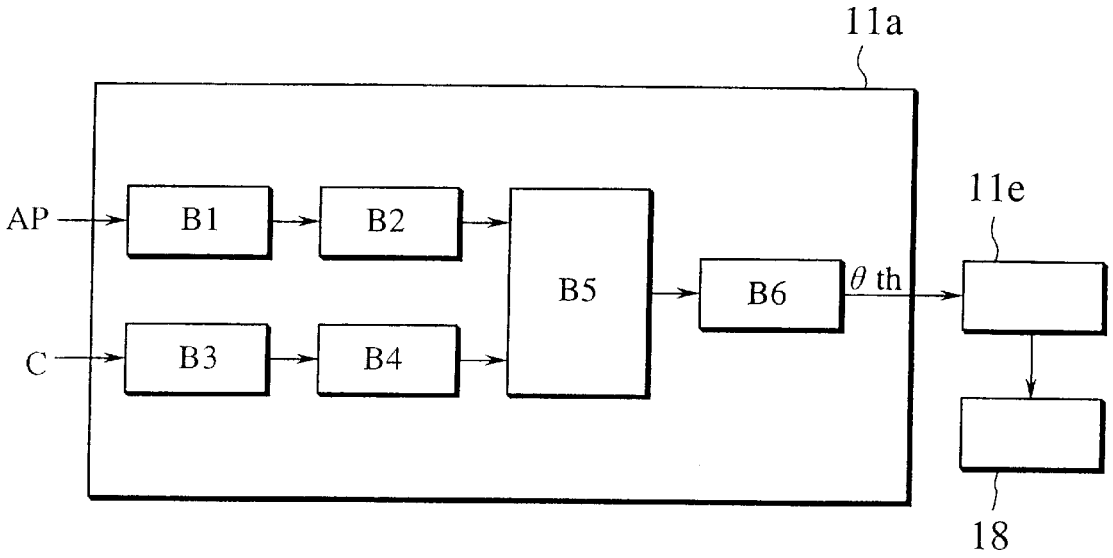
FIG. 11 is a view showing a block diagram of a control apparatus of an engine of the embodiment.

The process in step 1 in FIG. 2 is carried out in a target engine torque calculation block B1 in the CPU 11*a* shown in FIG. 11, the process in step 2 in FIG. 2 is carried out in a throttle valve target opening area calculation block B2 in the CPU 11*a* shown in FIG. 11, the process in the step 3 in FIG. 2 is carried out in an idling required air amount calculation block B3 in the CPU 11*a* shown in FIG. 11, the process for obtaining the throttle valve opening area corresponding to the idling required air amount among the processes in step 4 in FIG. 2 is carried out in a throttle valve opening area calculation block B4 in the CPU 11*a* shown in FIG. 11, the process for obtaining the throttle valve target total opening area among the processes in step 4 in FIG. 2 is carried out in a throttle valve total opening area calculation block B5 in the CPU 11*a* shown in FIG. 11, and the process in step 5 in FIG. 2 is carried out in a throttle valve target opening degree calculation block B6 in the CPU 11*a* shown in FIG. 11. The throttle valve target opening degree θth obtained in the throttle valve target opening degree calculation block B6 is sent to the throttle valve controller 18 through the output port 11*e*.

The entire contents of a Patent Application No. TOKUGANHEI 10-281083, with a filing date of Oct. 2, 1998 in Japan, are hereby incorporated by reference.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. A control apparatus of an engine comprising:

a throttle valve controller capable of controlling an opening degree of a throttle valve independent from an accelerator;

a target torque calculating section calculating a target engine torque using an operation amount of said accelerator;

a first opening area calculating section converting said target engine torque into a first opening area of said throttle valve;

an idling required air amount calculating section calculating a required air amount at the time of idling;

a second opening area calculating section converting said required air amount into a second opening area of said throttle valve;

a total opening area calculating section adding said first opening area of said throttle valve and said second opening area of said throttle valve to calculate a target total opening area of said throttle valve;

a target opening degree calculating section calculating a target opening degree of said throttle valve in correspondence to said target total opening area; and an output section outputting said target opening degree to said throttle valve controller;

wherein said second opening area calculating section converts said required air amount into said second opening area of said throttle valve in a sonic region.

2. A control apparatus of an engine according to claim 1, wherein said idling required air amount calculating section calculates said required air amount at the time of idling in a state in which an auxiliary equipment load is operated.

3. A control apparatus of an engine according to claim 2, wherein said idling required air amount calculating section calculates a target engine speed at the time of idling, calculates a maintaining air amount required for maintaining said target engine speed, calculates a feedback correction amount in accordance with a deviation between an actual engine speed and said target engine speed at the time of idling, calculates a correction air amount corresponding to said auxiliary equipment load, and adds said maintaining air amount, said feedback correction amount and said correction air amount together to obtain said required air amount at the time of idling in said state in which said auxiliary equipment load is operated.

4. A control apparatus of an engine according to claim 1, wherein said target torque calculating section calculates said target engine torque using a required engine torque corresponding to said accelerator operation amount and another required engine torque.

5. A control apparatus of an engine according to claim 4, wherein said target torque calculating section determines priorities of said required engine torque corresponding to said accelerator operation amount and said another required engine torque, and calculates said target engine torque based on said priorities.

6. A control apparatus of an engine according to claim 4, wherein said another required engine torque corresponds to a stabilization of a vehicle or a constant speed running of said vehicle.

7. A control apparatus of an engine according to claim 1, wherein said first opening area calculating section calculates a reference intake amount ratio corresponding to said target engine torque, calculates a normalized opening area corresponding to said reference intake amount ratio, and calculates said first opening area of said throttle valve by multiplying said normalized opening area by an engine speed and a piston displacement.

8. A control apparatus of an engine comprising:

throttle valve control means for controlling an opening degree of a throttle valve;

target torque calculating means for calculating a target engine torque using an operation amount of an accelerator;

first opening area calculating means for converting said target engine torque into a first opening area of said throttle valve;

idling required air amount calculating means for calculating a required air amount at the time of idling;

second opening area calculating means for converting said required air amount into a second opening area of said throttle valve;

total opening area calculating means for adding said first opening area of said throttle valve and said second opening area of said throttle valve to calculate a target total opening area of said throttle valve;

target opening degree calculating means for calculating a target opening degree of said throttle valve in correspondence to said target total opening area; and output means for outputting said target opening degree to said throttle valve control means;

wherein said second opening area calculating means converts said required air amount into said second opening area of said throttle valve in a sonic region.

9. A control method of an engine comprising:

calculating a target engine torque using an operation amount of an accelerator;

converting said target engine torque into a first opening area of a throttle valve;

calculating a required air amount at the time of idling;

converting said required air amount into a second opening area of said throttle valve;

calculating a target total opening area of said throttle valve by adding said first opening area of said throttle valve and said second opening area of said throttle valve;

calculating a target opening degree of said throttle valve in correspondence to said target total opening area; and controlling said throttle valve based on said target opening degree of said throttle valve;

wherein said first opening area of said throttle valve is obtained by calculating a reference intake amount ratio corresponding to said target engine torque, calculating a normalized opening area corresponding to said reference intake amount ratio, and multiplying said normalized opening area by an engine speed and an exhaust amount.

10. A control method of an engine according to claim 9, wherein said required air amount at the time of idling includes a required air amount at the time of idling in a state in which an auxiliary equipment load is operated, and wherein said required air amount at the time of idling in a state in which said auxiliary equipment load is operated is obtained by calculating a target engine speed at the time of idling, calculating a maintaining air amount which is required for maintaining said target engine speed, calculating a feedback correction amount in accordance with a deviation between an actual engine speed and said target engine speed at the time of idling, calculating a correction air amount corresponding to said auxiliary equipment load, and adding said maintaining air amount, said feedback correction amount and said correction air amount together.

11. A control method of an engine according to claim 9, wherein a required engine torque corresponding to said operation amount of said accelerator and another required engine torque are used, priorities of said required engine torque and said another required engine torque are determined, and said target engine torque is obtained based on said priorities.

* * * * *